United States Patent [19]

Felix

[11] 4,315,607

[45] Feb. 16, 1982

[54] METHOD AND APPARATUS FOR OBTAINING PREDETERMINABLE AND EXACT YARN LENGTH ON CROSS-WOUND BOBBINS

[75] Inventor: Ernst Felix, Uster, Switzerland

[73] Assignee: Zellweger Uster, Ltd., Uster, Switzerland

[21] Appl. No.: 127,058

[22] Filed: Mar. 4, 1980

[30] Foreign Application Priority Data

Apr. 10, 1979 [CH] Switzerland ..... 3413/79

[51] Int. Cl.[3] ..... B65H 63/08

[52] U.S. Cl. ..... 242/36; 242/39

[58] Field of Search ..... 242/36, 39, 28, 30, 242/49; 33/127; 340/677; 73/159, 160

[56] References Cited

U.S. PATENT DOCUMENTS

| | | | |
|---|---|---|---|
| 3,445,837 | 5/1969 | Lyons | 242/36 X |
| 3,450,358 | 6/1969 | Matsui | 242/36 X |
| 3,739,996 | 6/1973 | Matsui et al. | 242/39 |
| 4,024,645 | 5/1977 | Giles | 242/36 X |

FOREIGN PATENT DOCUMENTS

| | | | |
|---|---|---|---|
| 2313462 | 10/1974 | Fed. Rep. of Germany | 242/39 |

*Primary Examiner*—Stanley N. Gilreath
*Attorney, Agent, or Firm*—Craig & Antonelli

[57] ABSTRACT

The invention relates to a method and an apparatus for obtaining pedeterminable and exact yarn lengths on cross-wound bobbins. It is thereby assumed that all complete cops substantially have the same yarn length and of these only individual partial or remnant cops may contain less yarn. By determining the operation periods or the number of revolutions of the grooved cylinder or the cross-wound bobbin in relation to the yarn length of complete cops, counting values are introduced into a control unit which are totalled in this unit and compared with a set value which corresponds to the yarn length of the complete cross-wound bobbin. As soon as the set value has been obtained, the winding method is interrupted. Further developments of this method enable operating periods or the number of revolutions of different winding points to be compared and thereby to recognize defecting winding methods.

14 Claims, 4 Drawing Figures

METHOD AND APPARATUS FOR OBTAINING PREDETERMINABLE AND EXACT YARN LENGTH ON CROSS-WOUND BOBBINS

This invention relates to a method and apparatus for obtaining predeterminable and exact yarn lengths on cross-wound bobbins.

Cross-wound bobbins are produced in the textile industry in many ways, typical examples of which are through the use of winding frames and automatic bobbin winders. Cross-wound bobbins are produced on these devices and are then directed onto a warping creel. However, care must be taken that the cross-wound bobbins have as uniform a length as possible.

A considerable need in the textile industry would be met if the wound yarn length on all bobbins approached a certain preselected value as exactly as possible. If a precision of better than approximately 0.5% is achieved, there would be no need subsequently to position on the creel cross-wound bobbins which are too short, and the rewinding of the remnant of the yarn of cross-wound bobbins which are too long could be avoided.

In the case of automatic bobbin winders, several cops are usually successively unwound on a single cross-wound bobbin. By using provisional methods and apparatus, an attempt is made to achieve an approximately equal length of yarn on the cross-wound bobbins. In order to achieve this, it is, for example, known to hang rings on a chain over a cross-wound bobbin on the automatic bobbin winder so that on reaching a set diameter, the cross-wound bobbin begins to contact the suspended ring, while it continues to wind, and thus, the ring starts to oscillate. The operating staff then notices this, and it is a signal that the cross-wound bobbin must be removed. It has been shown that the precision of this apparatus is in the range of from 5 to 10% in practice.

Another more exact method is, for example, to count the number of revolutions of the grooved cylinder which drives the cross-wound bobbin during winding. However, the precision which is achieved by such an expedient is by no means sufficient to make it possible to dispense with the subsequent positioning or rewinding on the warping creel. The precision achieved in this way also only amounts to a few percent.

An object of the present invention is to avoid these disadvantages, through provision of a method and apparatus for controlling the winding of yarns on cross-wound bobbins in a unique and advantageous way.

The present invention takes advantage of certain known factors relating to the spinning operation. For example, the delivery cylinder on a ring spinning frame usually has a determined diameter at all the spinning points. Thus, the same quantity of yarn is necessarily produced at all the spinning points. As all the cops are spun simultaneously, they are also necessarily of the same length on the same ring spinning frame. By using, for example, a register with which the number of revolutions of the delivery cylinder is counted, the ring spinning frame can be switched off upon reaching a certain yarn length. Thus, not only the length of the cops is the same within a so-called doffing, but there are no differences from one doffing to another. There are likewise no differences between different ring spinning frames.

In the method according to the invention, this exactly-uniform length (lv) of the cop is used as a reference value for the formation of the desired length (Lks) of the cross-wound bobbin. Therefore, for example, exactly twenty cops may be wound on every cross-wound bobbin. These cross-wound bobbins would then under ideal conditions be very exact in respect of their length, with Lks being equal to exactly twenty Lv. However, the following circumstances must also be accounted for in practice:

1 Only in the most rare cases will the required yarn length be a whole figure multiple of the cops.

2. As a result, at the start of a cross-wound bobbin, complete cops can only be rarely started, because the first cop which was started by the previous cross-wound bobbin often remains unwound.

3. Cops which have a thread break during the spinning operation are shorter and, therefore, cannot be counted as a base value.

Here follows another basic concept of the present invention for solving these problems. The length of the cross-wound bobbins can be determined with a precision of a few percent by using auxiliary quantities. As an example, the following are considered as auxiliary quantities:

(a) the winding velocity or operating period during the winding of the cross-wound bobbin;

(b) the number of revolutions of the grooved cylinder or rotational speed of the grooved cylinder; and (c) the number of revolutions of the cross-wound bobbin.

These are only examples of auxiliary quantities which may be used in accordance with the present invention. In this regard, it should be recognized that other auxiliary quantities related to yarn length are also possible. These auxiliary quantities are then closely correlated with the wound yarn length according to the method of the present invention.

When based on the above-mentioned fact that all cops without thread breaks are of the same known length, then an exactly-defined relation of the length (Lks) of the cross-wound bobbin to one or a combination of these auxiliary quantities can be obtained by using such relation (reference value Rv) derived from the auxiliary quantities which have been mentioned by way of example. Thus, with the standard length (Lv) of the complete cops being known, even when partial cops having a yarn length Lt are used or the winding process is still in operation so that a remnant length Lr is used first, a positive determination may be obtained when the exact length (Lks) has been wound on the bobbin.

In the course of unwinding a number of cops onto a single cross-wound bobbin, the first and last cops may be partial cops and one or more intermediate cops may be partial cops as a result of a yarn break. However, it is assumed that the majority of the cops which go into the unwinding operation in connection with a single cross-wound bobbin will be the full standard cops of which the yarn length is known. Thus, the only thing that is required to accurately determine when the correct amount of yarn has been wound on the bobbin is to determine the length of yarn supplied by the various partial cops utilized during the winding operation.

In accordance with the method of the invention, an auxiliary quantity is selected which in some way relates to the length of yarn on a standard cop and a reference value Rv is selected on the basis of this auxiliary quantity to aid in determining the length of yarn supplied by these partial cops. As an example, the reference quantity Rv represents the time in minutes that it takes to unwind a standard cop. Thus, if a remnant cop is used as the first cop during the winding operation, the length of yarn supplied by that remnant cop can be determined on the basis of the duration of unwinding of that cop during the previous operation in comparison to the reference value Rv. Similarly, if a partial cop results from a yarn break, the length of yarn supplied can be determined by comparing the period of the unwinding of that cop to the reference value Rv. The amount of unwinding from a final cop during the winding operation is determined in the same way with respect to the reference value Rv.

To accomplish all of this, it is necessary to measure the unwinding period of each cop and compare it to the value Rv to determine whether the cop is a full cop or a partial or remnant cop. In addition, it is known that the auxiliary quantities which may relate to the length of the yarn often vary during the winding operation so that the reference value Rv might not be constant for all cops. Thus, in accordance with the present invention, the auxiliary quantity, such as the unwinding period, is determined for each cop during the winding operation, and this becomes the updated reference value Rv for the next cop.

These and other objects, features and advantages of the present invention will become more apparent from the detailed description which relates to various exemplary embodiments.

The invention will now be described with reference to the accompanying drawings in which.

Figure 1:
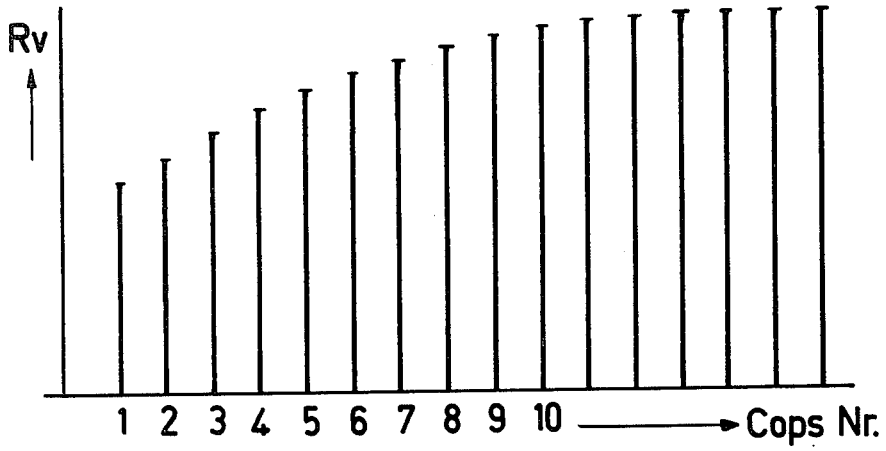
FIG. 1 is a line diagram of the distribution of the unwinding length of a number of complete cops in the winding of a cross-wound bobbin.

The method according to the present invention will now be explained more clearly by way of an example. It is assumed that the length of the cops without any thread breaks amounts, for example, to 2000 m, all of the ring spinning frames which produce yarns for the relevant winding method being adjusted so that the cops are exactly 2000 m long.

In this example, the operating period (unwinding period of the bobbin for a single cop) is chosen as an approximate reference or auxiliary quantity. Thus, the reference value Rv on which the unwinding length is based will be equal to the time required to unwind a single cop of known length from which the number of cops to provide the required winding length Lks on the cross-wind bobbin can be determined. It is further assumed that the circumferential velocity of the grooved cylinder is 1000 m/min; thus, a winding velocity of approximately 1000 m/min is expected.

With a yarn length Lv of the cop of 2000 m and having exactly 1000 m/min winding velocity, this would amount to a winding time of exactly two minutes to exhaust a single typical cop. Thus, the value of Rv would equal 2 min. However, since the winding velocity does not conform exactly with the circumferential velocity of the grooved cylinder, in practice, the operating period will not be exactly two minutes. On this basis, if it is now assumed that the actual operating period to exhaust a single cop is 2.15 minutes, the effecting winding velocity will be only 930 m/min instead of 1000 m/min. Thus, the reference value Rv on which the measurement of yarn length is based must be increased to 2.15 for the start of the cross-wound bobbin on the basis of this fact.

When, at the start of the next cross-wound bobbin, a cop is started which is no longer complete, which is very probable, the first-obtained relation of the winding velocity of 930 m/min can be used advantageously to determine the starting length available on this cop. Therefore, for example, at the next cross-wound bobbin, if an operating period of the incomplete cop of 0.9 mins is determined by comparing the unwinding time already used for the previous bobbin with the value Rv, then this produces a length of 0.9 minutes$\times$930 m/min$=$837 m. This length is then added to the lengths obtained from the succeeding cops until a total length of Lks is reached.

In the same manner as determined for an incomplete cop at the start of a cross-wound bobbin, the length (Lt) of partial cops can now be accounted for. This is simply done by comparing the winding time for that cop to the value Rv to determine what portion of a complete cop has been obtained. This also applies to the end of the cross-wound bobbin when a complete cop is not required to reach the end of the same. The total length wound up to that point is compared to the desired length Lks to see how much more is needed and this result is compared to Rv to see how much winding time is needed on the last cop.

It is possible that the length determined via the auxiliary quantity is only conditionally exact. Since, however, the greatest part of the cross-wound bobbin is formed from complete cops, a small inexactitude of a partial cop no longer has a relatively-great effect.

In practice it has admittedly been shown that the relations of winding velocity to circumferential velocity of the grooved cylinder, for example, can change during the winding of the cross-wound bobbin along with other relationships on which the auxiliary quantities may be based. At the beginning of winding on a cross-wound bobbin, the slip between the grooved cylinder and the cross-wound bobbin can be, for example, greater or smaller than at the end of winding; or, during the winding of the cross-wound bobbin, for a revolution of the same, the yarn length can be substantially shorter at the start of winding than with complete cross-wound bobbins. This fact can also be accounted for in the method according to the invention, in that the reference value (Rv) is determined according to the winding course of the cross-wound bobbin.

The method according to the invention could be carried out, for example, in a practical manner as follows: A complete cop (No. 1) is creeled in the automatic bobbin winder at the start of a cross-wound bobbin. As in the previous example, the operating period is chosen as the auxiliary quantity. This is determined by measuring the time until the first cop has unwound, which becomes the reference value Rv as it is to be used at the start of a cross-wound bobbin. In the above example, this value was initially set at 2.15 minutes. Then, as cop No. 1 is unwound the winding time is measured and the value Rv is adjusted accordingly for the next cop. The next cop (No. 2) is now unwound, and its unwinding length becomes the reference value (Rv) for the next piece of the cross-wound bobbin. The method is now carried out in the same manner until the cross-wound bobbin is complete. FIG. 1 gives a corresponding example of this method in which it is shown how the value Rv is adjusted for each cop during the winding of the bobbin.

It has been assumed in the above embodiments that all cops are of the same length (Lv). However, as also indicated, it must also be taken into account that thread breaks may have appeared at individual spinning points and the relevant cops therefore no longer have the set lengths. It is obvious that the thread breaks can only shorten the yarn lengths of the relevant cops, and cannot increase them. There is no circumstance at all by which the yarn length of the cops could be increased.

It can now be predetermined from the yarn operating period when the end of an unwound cop is to be expected from the reference value (Rv) derived from the previous cop. If there has been a thread break, then the end of the cop arrives earlier than expected. Thus, it is important that the shortening of the yarn during retying is not effected to a slight extent, but amounts to several percent of the length of the cop, so that this condition can be easily detected.

From the reference quantity Rv, for example, the operating period, which is admittedly not very exact, can, however, be usually determined with sufficient reliability whether a cop having a thread break has been fed or not. Thus, it is possible to recognize these cops which have had at least one thread break, and to eliminate them as a reference value (Rv) for the succeeding cop.

Figure 2:
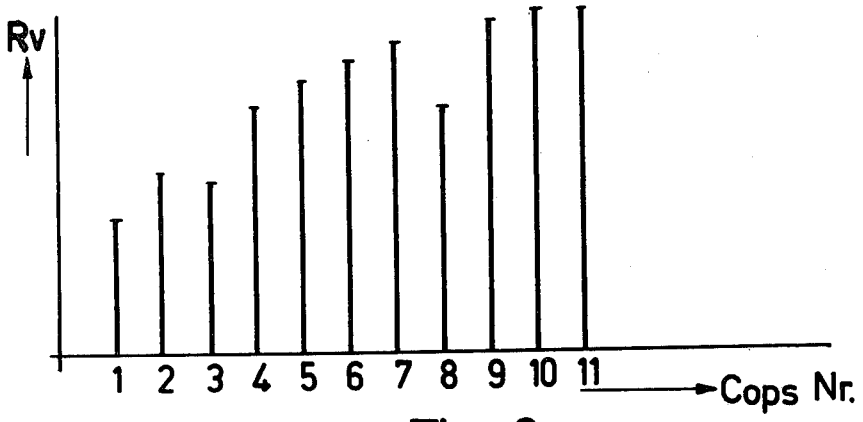
FIG. 2 is another line diagram of the distribution of the unwinding lengths of complete and partial cops in the winding of a cross-wound bobbin.

If, during the first run of a cross-wound bobbin, there have been cops with thread breaks, then the operating period would have deviated from the continuous course of the reference values Rv, as shown in FIG. 2. Cops Nos. 3 and 8 are obviously too short. These deviations can be easily recognized and the relevant reference values can be eliminated from the adjusting process. During the further course of the winding process, the reference values Rv can still be controlled on the basis of the reference values for the full cops. If necessary, they must also be corrected. This would be necessary, for example, in view of the changing relations.

The reference values (Rv) have now been established for the course of winding of the cross-wound bobbin. Intermediate values can be interpolated. Since the winding course of all the other cross-wound bobbins very probably remains the same at the same winding point, partial cops having yarn lengths (Lt) can also be used at every point of the cross-wound bobbin.

Figure 3:
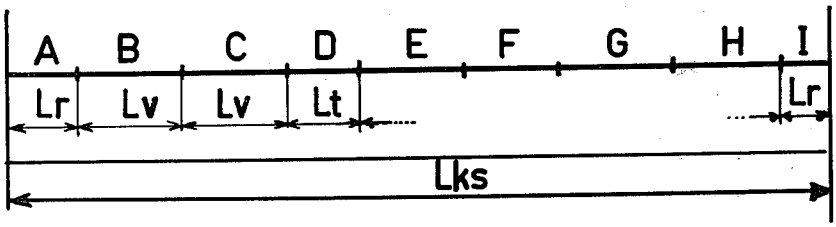
FIG. 3 is a schematic diagram of the total length of a number of cops wound on a single bobbin.

FIG. 3 graphically shows the method of the winding course according to the invention as an example during the production of a cross-wound bobbin having an exact yarn length. The section A is the remnant (Lr) of the cop which is still creeled. The start of the same has been used for the last cross-wound bobbin. The length (Lr) of the remnant can be determined fairly exactly from the reference value (Rv) in the manner already described. The sections B and C correspond in length to the set length (Lv) according to the reference value (Rv), and thus, it can be assumed that these sections relate to complete cops, that is, they have an exact length. Section D is obviously a partial cop (possibly a cop having a thread break). Its length (Lt) can be determined sufficiently exactly from a comparison of its operating period to the value of Rv. Sections E, F, G and H are complete cops. The respectively-wound length can always be determined exactly from the total the length of remnant cop (Lr), the lengths of the partial cops (Lt), and the number of complete cops (Lv). At the end of section H it is, for example, known exactly how much yarn there is already on the cross-wound bobbin and which remnant length Lr of crop I is still to be unwound until the required exact length (Lks) of the cross-wound bobbin has been obtained.

Upon reaching the required length, for example, with the aid of an electronic yarn cleaner, the yarn of cop I can now be cut off. With the aid, for example, of a signal indicating the end of the winding operation, the winder is able to see that this cross-wound bobbin has obtained the required length and is to be replaced. With an automatic replacement of the cross-wound bobbin, a sequence of automatic operations can be introduced with the aid of the above-mentioned signal.

In the mentioned example, the operating period has been chosen as an auxiliary quantity, whereby the reference value (Rv) has been adjusted from the cop length. The dimension of the reference value (Rv) in this case is "length per unit of time", for example, m/min. As was mentioned at the outset, other auxiliary quantities can also be included. Choosing the operating period is particularly favorable because, in many cases, electromechanical or electronic warp stop-motions are already present on automatic bobbin winders, which indicate the operating period.

It is also advantageous to compare the reference values (Rv) of various winding points. The values can often deviate from each other, for example, by frequently-adjusted thread breaks, so that differing thread tensions and thereby differing slip relations are produced between the driving grooved cylinder and the driven cross-wound bobbin. This will produce significant and repeated deviations between the successive measured values. If the deviations are too large, then a signal can also be emitted as the conclusion can very probably be drawn from this that something is wrong at the relevant winding points. Therefore, the present method also facilitates the perception of disturbed winding points. The characteristic course of the reference measurement can moreover also be a qualitative feature of the winding process.

The process for receiving the reference values, the operating periods, etc., is, however, rather time consuming. Modern electronics, particularly the use of micro computers, allows the previously-described methods to be programmed accordingly. Measurements of time can be carried out automatically, reference values can be stored in the memory of the micro computer, etc.

It is not only possible for the reference values to be retained, but their continuity can also be tested automatically. It is also possible to compare the winding points automatically. Where the deviations are too large a signal can be emitted whereby a set-up is produced with which malfunctioning winding points can be indicated.

Figure 4:
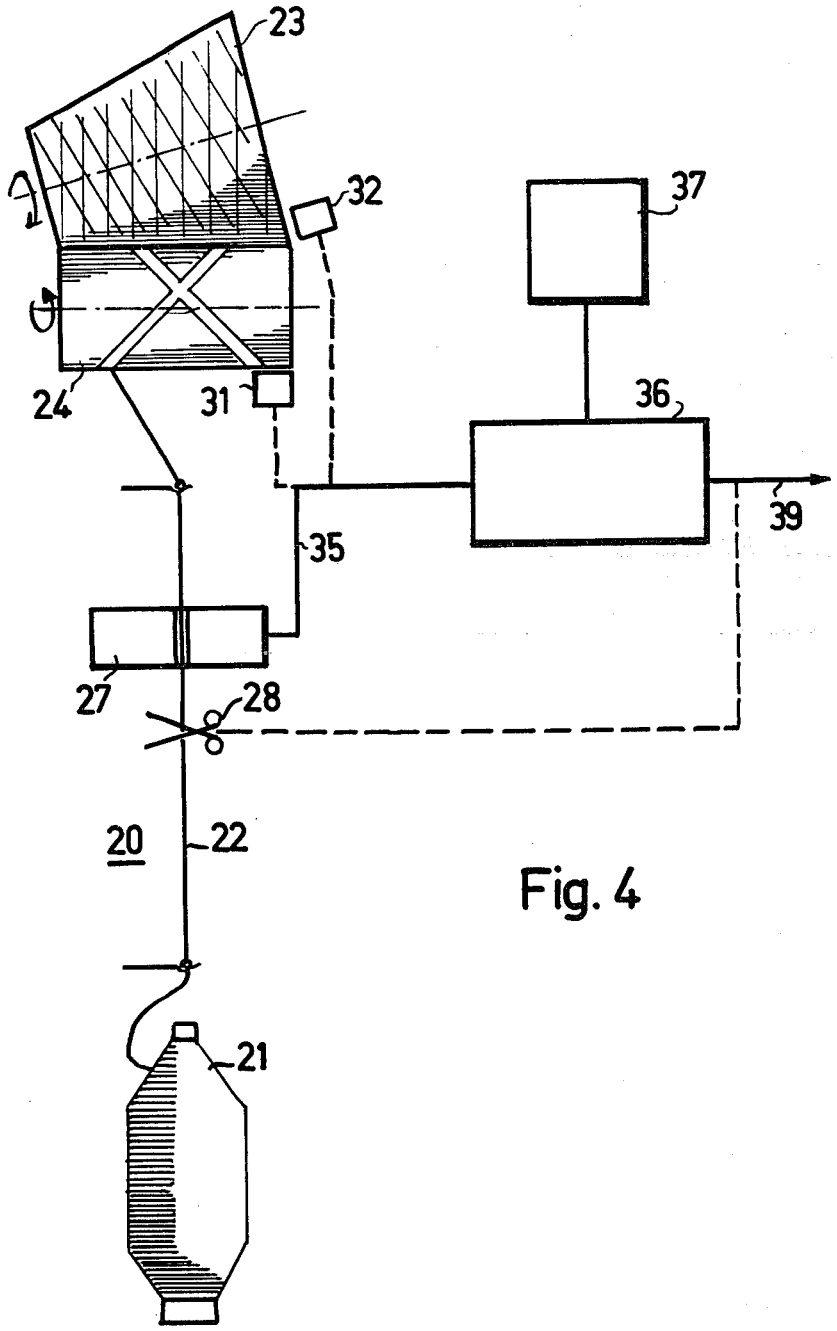
FIG. 4 is a schematic diagram which illustrates the winding point and a control apparatus comprising measurement and evaluation devices for carrying out the method of the present invention.

FIG. 4 schematically illustrates a winding point 20 having sensors and the necessary evaluation apparatus for performing the method of the present invention. The yarn 22 unwinding from the cop 21 passes through a warp stop-motion device 27, a thread-dividing apparatus 28, and is wound over the grooved cylinder 24 onto the cross-wound bobbin 23 in the manner known in the art. The warp stop-motion device 27 can, for example, be part of a yarn cleaner, which also contains the cutting apparatus 28.

During the duration of the run of the yarn, the warp stop-motion device 27 sends out a signal to the control unit 36, which signal provides an indication of the beginning and end of the winding operation for each cop on which a measurement of the winding period for each cop can be determined in the control unit. The control 36 not only includes a clock timer arrangement which is responsive to the output of the warp stop-motion device 27, but also includes an arithmetic and storage unit for calculating the lengths of yarn supplied by the successive cops on the basis of the reference value Rv and accumulating the successive measurements until the desired length (Lks) is reached. In this regard one or more comparators are provided in the control unit 36 to compare the accumulated value to the value (Lks), to compare the measured winding period to the reference value Rv, and to compare the desired partial winding length of a final cop to the output of the clock timer arrangement.

A storage device is also provided for storing the reference value Rv, which is then updated for each cop on the basis of the measurement carried out for the previous cop, unless the previous cop was a partial cop. If the number of revolutions of the grooved cylinder 24 or of the cross-wound bobbin 23 are used as the basis for such measurement, sensors 31 or 32 are set up at corresponding points to send out the required counting values.

A set data source 37 is allocated to the control unit 36 for supplying thereto parameter signals relating to both the length Lv of a complete cop 21 and also the required total length (Lks) of the cross-wound bobbin, as well as possibly also an initial value of Rv.

The control unit 36 has an input 35 through which are introduced the signals of the warp stop-motion device 27 and of the sensors 31 or 32. The output 39 of the control unit 36 on the one hand operates the cutting apparatus 28 and on the other hand it also supplies control signals to control the winding process. Also, while this control unit 36 may be formed of discrete elements as described above, it should also be apparent that it may also take the form of a computer programmed to carry out the necessary arithmetic, comparison and control operations required by the present invention.

While I have shown and described several embodiments in accordance with the present invention, it is understood that the same is not limited to the details shown and described herein but is susceptible of numerous changes and modifications as known to those of ordinary skill in the art, and I therefore do not wish to be limited to the details shown and described herein but intend to cover all such changes and modifications known to one of skill in the art.

What is claimed is:

1. A method of obtaining predeterminable and exact yarn lengths on cross-wound bobbins during a winding process, wherein complete cops of precisely-known yarn length and also partial cops are unwound, the method comprising the steps of selecting a reference quantity (Rv) as an auxiliary quantity, which is at least approximately correlated with the yarn length (Lks) on the cross-wound bobbin; comparing for each cop the measured auxiliary quantity to the reference quantity (Rv) to determine if the cop provides the yarn lengths (Lt) of an unwound partial cop or the unwound length (Lr) of a remnant cop which is still being unwound; calculating the yarn lengths (Lt) and (Lr) of partial and remnant cops, respectively, obtaining a total of the wound yarn lengths (Lv), (Lt) as each cop is unwound until that total equals the required yarn length (Lks) on the cross-wound bobbin, and interrupting the winding operation when a length (Lks) has been reached.

2. A method according to claim 1, characterized in that the relation of the operation period to the duration of unwinding of a complete, perfect cop at the relevant winding point is used as the reference quantity (Rv) for the yarn length.

3. A method according to claim 1, characterized in that the winding on the bobbin is effected by use of a grooved cylinder and the relation of the number of revolutions of the grooved cylinder to the duration of unwinding of a complete, perfect cop is used as the reference quantity (Rv) for the yarn length.

4. A method according to claim 1, characterized in that the relation of the number of revolutions of the cross-wound bobbin to the duration of unwinding of a complete, perfect cop is used as the reference quantity (Rv) for the yarn length.

5. A method according to claim 1, further including the step of adjusting the reference quantity (Rv) according to typical variations of said auxiliary quantity within the course of winding of the cross-wound bobbin.

6. A method according to claim 1, characterized in that the adjusting of the reference quantity (Rv) includes the steps of predetermining a value for an initial cop, comparing the measured auxiliary quantity for a cop with the previously-determined reference quantity (Rv), and at least partially correcting the reference quantity (Rv) for the next cop in the further determination of the yarn length (Lks).

7. A method according to claim 6, characterized in that cops whose reference quantities (Rv) deviate by more than a predetermined amount from those of the previous cops are not used in said comparison to adjust further reference quantities (Rv).

8. A method according to claim 1, characterized in that the reference quantities (Rv) are determined by averaging an auxiliary quantity from a plurality of winding points, thereby enabling a characteristic course of reference quantities (Rv) to be recognized during the build up on the cross-wound bobbin.

9. A method according to claim 8, including the step of generating a signal where deviations in the characteristic course of the build up on the cross-wound bobbin exceeds a predetermined amount, which signal indicates this excessive deviation.

10. A method according to claim 8, including the step of generating a signal where deviations at individual winding points in the characteristic course of the build up on the cross-wound bobbin deviate from the average of various winding points by more than a predetermined amount, which signal indicates this excessive deviation.

11. An apparatus for obtaining predeterminable and exact yarn lengths on cross-wound bobbins by unwinding from a plurality of cops, which include complete cops of precisely-known yarn length and partial cops, comprising measuring means for determining an auxiliary quantity through the use of which the yarn length supplied by an individual cop can be at least approximately measured; and control means responsive to signals representing the length (Lv) of a complete perfect cop and the required length (Lks) of the cross-wound bobbin for summing the lengths of yarn supplied to said bobbin from said cops including means responsive to the signal of the measuring device for determining whether each cop is a complete cop or a partial cop, means for determining the length of yarn supplied by each partial cop by comparing the measured value to a reference value representing a complete cop, means for adding the yarn lengths supplied by the successive cops, and means for stopping the winding operation upon reaching the required yarn length (Lks).

12. An apparatus according to claim 11, wherein said measuring means includes sensor means for determining the yarn length on a cop as a reference quantity (Rv) in the form of a count of the winding revolutions for each cop.

13. An apparatus according to claim 11, wherein a grooved cylinder is provided for winding the yarn from said cops on said bobbin, the number of revolutions of the grooved cylinder being used as said auxiliary quantity.

14. An apparatus according to claim 11, characterized in that the number of revolutions of the cross-wound bobbin is used as said auxiliary quantity, and including sensor means for measuring said revolutions.

* * * * *